US007662198B2

(12) United States Patent
Jansen et al.

(10) Patent No.: US 7,662,198 B2
(45) Date of Patent: Feb. 16, 2010

(54) SEPARATION ASSEMBLY FOR A VACCUUM CLEANER WITH MULTI-STAGE DIRT SEPARATION

(75) Inventors: Kasper Nicolaas Jansen, Hoogeveen (NL); Margarita Zwanette Van Raalte, Hoogeveen (NL); Jarno Beekman, Hoogeveen (NL); Wiebe Wierda, Hoogeveen (NL); Bernardus Lubbertus Kuiper, Hoogeveen (NL); Bart-Jan Zwart, Foxhol (NL); Henriette Marieke Seinen, Hoogeveen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 512 days.

(21) Appl. No.: 10/592,771

(22) PCT Filed: Mar. 4, 2005

(86) PCT No.: PCT/IB2005/050814

§ 371 (c)(1),
(2), (4) Date: Sep. 14, 2006

(87) PCT Pub. No.: WO2005/089617

PCT Pub. Date: Sep. 29, 2005

(65) Prior Publication Data

US 2008/0134462 A1 Jun. 12, 2008

(30) Foreign Application Priority Data

Mar. 15, 2004 (EP) ..... 04101046

(51) Int. Cl.
*B01D 50/00* (2006.01)

(52) U.S. Cl. ..... 55/337; 55/356; 55/DIG. 3; 55/426; 55/428; 55/429; 55/467; 55/471; 55/486; 15/353; 15/352; 15/347; 96/11; 96/416

(58) Field of Classification Search ..... 55/321–323, 55/337, 356, DIG. 3, 426, 428–429, 467, 55/471, 486, 476, DIG. 34; 15/353, 352, 15/347; 96/11, 416–417
See application file for complete search history.

(56) References Cited

U.S. PATENT DOCUMENTS

| | | | | | |
|---|---|---|---|---|---|
| 1,556,592 | A | * | 10/1925 | Donaldson | 55/329 |
| 2,230,453 | A | * | 2/1941 | Fitch | 96/308 |
| 3,320,727 | A | * | 5/1967 | Farley et al. | 55/337 |
| 3,925,044 | A | * | 12/1975 | Tu et al. | 55/337 |
| 4,099,940 | A | * | 7/1978 | Mortensen et al. | 55/300 |
| 6,001,151 | A | * | 12/1999 | Elshout | 95/25 |

(Continued)

FOREIGN PATENT DOCUMENTS

DE 3413213 A1 * 10/1985

(Continued)

*Primary Examiner*—Jason M Greene
*Assistant Examiner*—Dung Bui

(57) ABSTRACT

A separation assembly for separating dirt and dust from air in a vacuum cleaner, through which assembly an air flow path extends from an inlet to an outlet. The air flow path extends through an upstream separator and a downstream separator. The downstream separator includes an air-permeable filter element bounding an inner space. The wall sections bounding the air flow path in the area of the downstream separator include at least a transparent section through which the filter element is visible. The inner space is located upstream of an area outside the filter element for filtering air flowing from inside the filter element to outside the filter element.

11 Claims, 1 Drawing Sheet

U.S. PATENT DOCUMENTS

Figure 1:
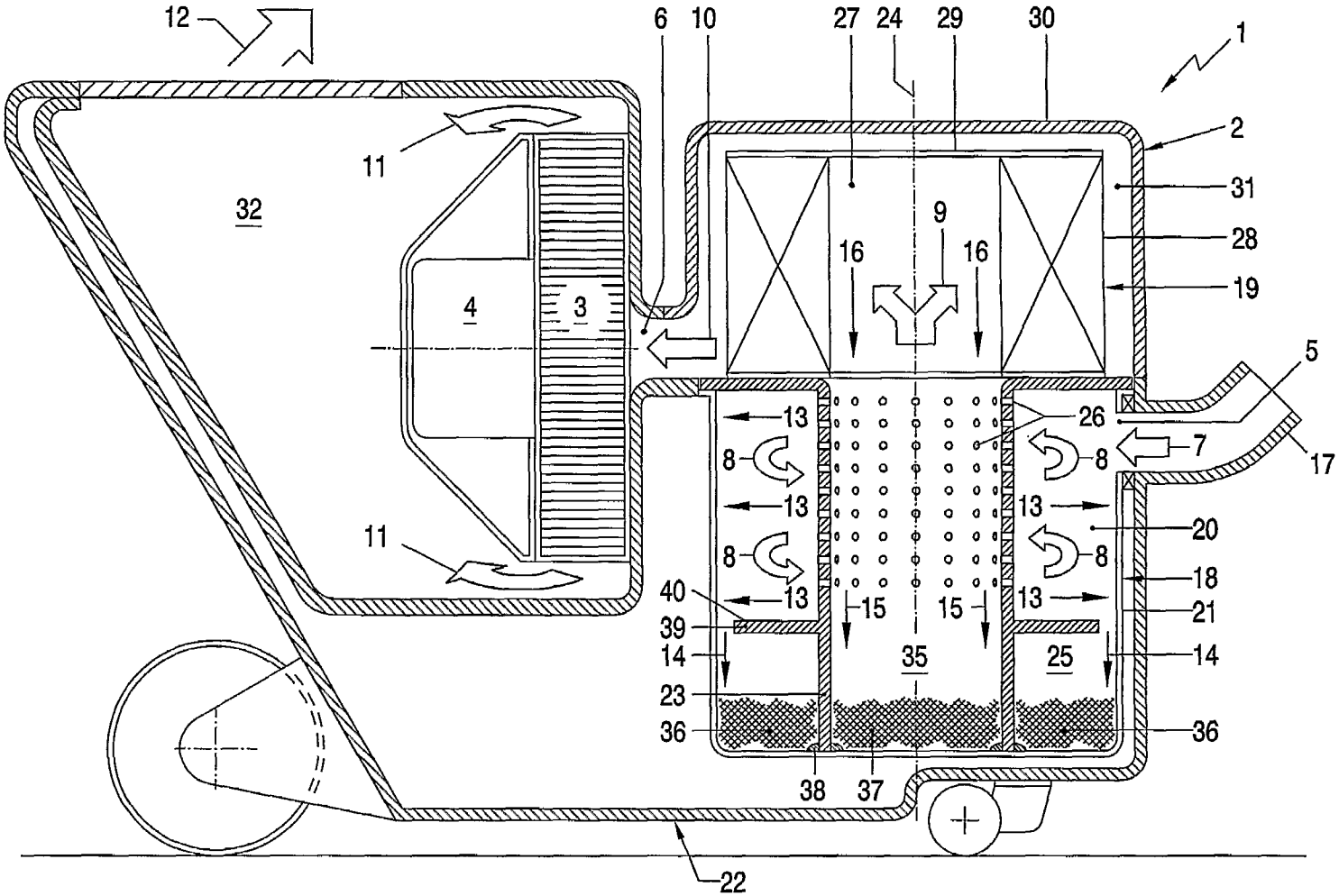

| | | | | |
|---|---|---|---|---|
| 6,289,553 | B1 | 9/2001 | Dyson | |
| 6,497,756 | B1 * | 12/2002 | Curado et al. | 96/117.5 |
| 2003/0046910 | A1 * | 3/2003 | Lee et al. | 55/426 |
| 2004/0010885 | A1 * | 1/2004 | Hitzelberger et al. | 15/352 |
| 2004/0025285 | A1 * | 2/2004 | McCormick et al. | 15/352 |
| 2004/0078923 | A1 * | 4/2004 | Streciwilk | 15/347 |
| 2004/0083896 | A1 * | 5/2004 | Mihaylov et al. | 96/414 |

FOREIGN PATENT DOCUMENTS

| | | |
|---|---|---|
| WO | WO 01/32066 | 5/2001 |
| WO | WO 2004/008932 | 1/2004 |

* cited by examiner

SEPARATION ASSEMBLY FOR A VACCUUM CLEANER WITH MULTI-STAGE DIRT SEPARATION

The invention relates to a separation assembly for separating at least solid particles from air in a vacuum cleaner, comprising an air inlet, an air outlet, wall sections bounding an air flow path from the inlet to the outlet, and at least two separators for separating at least solid particles from the air, wherein the air flow path extends through said separators, an upstream one of said separators being located upstream of a downstream one of said separators, and wherein the downstream separator includes an air-permeable filter element bounding an inner space.

The invention further relates to a vacuum cleaner incorporating a separation assembly according to the invention and including a fan in the air flow path.

In many vacuum cleaners a filter is arranged downstream of a first separator for separating solid particles—such as dirt and/or dust—from an air flow. In the known vacuum cleaners, the first separator is usually a cyclonic separator or a dust bag. The filter usually has an operating life time that is a number of times longer than the operating time after which dirt needs to be removed from the first separator, for instance by emptying the dirt collection chamber or by disposing of a filled dust bag. Thus, in most cases the filter is not replaced when the dirt and dust accumulated in the first separator is discharged. When discharging the dirt and dust accumulated in the first separator, dust may be removed from the filter to reduce the resistance of the air flow through the filter.

In WO-A-01/32066 a description is given of a dust and dirt separation assembly for use in a vacuum cleaner in which an air flow path passes firstly through a cyclonic separator for separating larger particles from the dirty air and secondly through a filtration element for separating smaller particles of dust from the dirty air. A dirt collection chamber to receive dirt from the cyclonic separator and dust from the filter element is located below a central tube in a separating chamber of the cyclonic separator and a disk with flanges extending outward and obliquely downward is arranged between the separating chamber and the dirt collection chamber. The filter body is of a cylindrical design and is mounted inside the tube in a position coaxial with the tube. A striker member is operable to strike the filter element to dislodge the dust from the filter element so that the dust enters the collection chamber with the larger particles of dirt.

A problem of this dirt separation assembly is that leaks in the filter that substantially reduce the effectiveness of the filter typically remain unnoticed by users of the vacuum cleaner.

It is an object of the present invention, to provide a solution that allows the user to simply notice whether there is a leak in the filter.

To achieve this object, a separation assembly according to the present invention is characterized in that the wall sections bounding the air flow path in the area of the downstream separator include at least a transparent section through which the filter element is visible, and in that said inner space is located upstream of an area outside the filter element for filtering air flowing from inside the filter element to outside the filter element. The filter body is visible through the transparent section, and in the event of a leak the leak is easily noticeable by dust traces at the leak and/or on the transparent section.

Particular embodiments of the invention are set forth in the dependent claims.

Figure 2:
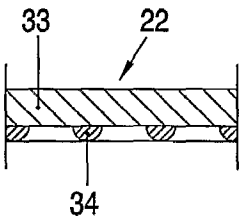

Embodiments, further objects, aspects and effects of a separation assembly in accordance with the invention will be described in detail in the following with reference to the drawings, wherein:

FIG. 1 is a schematic cut-away side view of a vacuum cleaner including an example of a separating assembly according to the invention; and FIG. 2 is a cross-section of a portion of a filter element of the separating assembly according to FIG. 1.

In the vacuum cleaner 1 shown in the drawings, an example of a separation assembly 2 according to the invention is incorporated. In operation, the separation assembly 2 separates solid particles from air that is displaced through the vacuum cleaner by a fan 3 driven by a motor 4.

The separating assembly 2 has an air inlet 5 and an air outlet 6. Between the inlet 5 and the outlet 6, internal surfaces of the separating assembly 2 bound an air flow path. In the drawings, thick arrows 7-12 drawn in outline indicate the air flow along the air flow path. Narrow arrows 13, 14 depict the general directions of migration of solid particles causing separation from the air flow when the vacuum cleaner is in operation and the narrow arrows 15, 16 depict migration of solid particles dislodged from the filter while the vacuum cleaner 1 is not in operation (or at least the fan 3 is not running). In the separation system according to the present example, the particle movement depicted by the arrows 13 and 14 may, in principle, also include movement of liquid droplets such as droplets of a mist of water entrained with the air flow.

The inlet 5 of the separating assembly 2 is located downstream of a connector to which a vacuum cleaner hose can be connected.

The air flow path extends through an upstream separator 18 and a downstream separator 19 downstream of the upstream separator 18. Within the framework of the invention, other separators may be provided upstream and/or downstream of the upstream and downstream separators and/or between the upstream and downstream separators.

According to the present example, the upstream separator 18 is a cyclonic separator having a separating chamber 20 bounded by a bin 21 that is removable from a housing 22 of the vacuum cleaner 1. The separating chamber is of a substantially annular shape and extends circularly about a central tubular member that has a central axis 24 in common with the separating chamber 20.

In operation, the air enters the separating chamber 20 via the inlet 5 with a directional component tangential to the central axis 24, so that a cyclonic air flow is created and maintained in the separating chamber 20. This causes solid and liquid material to migrate to the outside wall of the separating chamber 20 where most of the material slows down when it hits the wall and falls down into an, also annular, accumulating chamber 25 under the separating chamber—during operation or after the vacuum cleaner has been switched off.

The tubular member 23 has an upper section that is permeable to air because it is provided with a plurality of holes 26. Via the holes 26, the air leaves the separating chamber 20 at the inside thereof, where the air contains the lowest concentration of particles and/or droplets. Moreover, the fraction of particles and droplets that is entrained by the air flow out of the separating chamber against the centrifugal forces exerted thereon is a fraction of the particles that is of a small size, generally referred to as dust.

From the tubular member 23 of the upstream separator 18, the air flow enters an inner space 27 of the downstream separator 19, which chamber 27 is bounded by an air-permeable filter element 28 and closed off by an essentially airtight cover 29. In operation, the air flow is forced through the air-permeable filter element 28, as indicated by the double arrow 9, so that a fine fraction of the particles in the air flow, that has not been removed from the air flow in the cyclonic separator 18, is filtered out of the air.

In the area of the downstream separator 19, the air flow path is bounded by a transparent wall section, according to this example formed by a hood 30, through which the filter body is visible, because the transparent wall section also forms a part of the outside of the separating assembly 2 (and of the vacuum cleaner 1). The transparent section may also be provided in the form of one or more transparent windows in an otherwise non-transparent wall section.

Because the inner space 27 is located upstream of a portion of a filter chamber 31 outside the filter element 28, for filtering air flowing from inside the filter element 28 to outside the filter element 28, any leak in the filter element is easily noticeable by dust traces at the leak and/or on the transparent wall section 30. Moreover, the dirty side of the filter is on the inside, so that the filter keeps a fresh look as long as it is operating properly and indications on the filter, that may for instance indicate the type of filter or the moment in time when it was installed, remain clearly visible, even after a long period of use.

Air that has been filtered by the filter passes through the filter chamber 31 to the fan 3, as indicated by the arrow 10, and is forced out of the vacuum cleaner after the flow has expanded and thus reached a lower velocity in a chamber 32 downstream of the fan 3 (arrows 11, 12).

The air-permeable membrane 33 (see FIG. 2) of the filter element 28 is preferably made of a material to which dust does not tend to adhere, such as ePTFE that is typically of an essentially white opaque color, and provided with a backing 34. A color marking of the filter element 28 that remains brightly visible during use can be achieved particularly easily by providing that the backing 34 on the outside of the membrane 33 is colored. A bright color that strongly contrasts with the, usually grayish, dust is also helpful for facilitating detection of leaks, because any dust on the outside of the filter element 28 is better visible against a contrasting background.

The air-permeable membrane 33 of the filter element 28 preferably meets EN 1822 class H10 or higher.

The central tube 23 of the upstream separator 18 bounds a central chamber 35 inside the tube 23. The separating chamber 20 communicates with the central chamber 35 via the air-permeable upper section of the central tube 23 that forms the outlet for allowing air to leave the separating chamber 20. The central tube 23 has a non-permeable lower section. In the operating condition shown, the inner space 27 in the filter element 28 is open in a downward direction and located above and in open communication with the non-permeable lower section of the central chamber 35. This allows dust to fall out of the inside of the filter element 28 into a lower section of the central chamber 35 when the vacuum cleaner 1 is switched off. Release of dust clinging to the inside of filter element 28 is enhanced by brisk movements of the vacuum cleaner 1 as it is rolled over uneven surfaces and/or when it hits objects. Release of dust from the filter may also be aided by subjecting the filter element 28 to tapping, brushing, deformation and/or other treatments. Assemblies that may be incorporated in a vacuum cleaner for automatically carrying out such treatments are known as such.

Because the dust that drops out of the filter element 28 falls to a lower, closed section of the central chamber 35, it is collected in a portion of the chamber 35 through which the main air flow does not pass when the vacuum cleaner 1 is again put into operation. Thus, the dust collected in the lower portion of the central chamber will show relatively little tendency to be blown back into the filter element 28 again when the vacuum cleaner 1 is again put into operation. Dust and dirt 36, 37 that has been accumulated in the accumulating chamber 25 and the central chamber 35 can easily be removed from the vacuum cleaner 1, by taking the bin 21 out of the housing 22 and emptying it into a waste collecting container. This involves temporary displacement of the filter element 28 and the hood 30 to gain access to the bin 21. However, because the dirty side of the filter element 28 is on the inside, this entails only minimal dust dispersion and/or risk of soiling.

According to the present example, the lower end of the central tube 23 is sealed against the bottom of the bin 22 by a seal 38, to avoid an air flow through the dust and dirt accumulation areas that would cause dirt and dust to be entrained. However, it is also possible to provide the central tube 23 with an integral closed bottom. This eliminates the need for sealing the central tube 23 against the bottom of the bin 21, but entails that dust accumulated in the lower section of the central chamber 35 is discharged separately from the central tube 23. Flanges extending vertically, preferably from the bottom of the chamber, and being preferably radially oriented, may be provided in the dirt and dust collecting chambers 25, 35 to inhibit air movement in the chambers 25, 35.

A flange 39 extends around the central tube 23 to within a short distance from the peripheral wall of the separating chamber 20. The flange spacing between the free end of the flange 39 and the peripheral wall of the separating chamber 20 is preferably uniform, preferably at least 3 mm and preferably less than 10 mm. The flange 39 has a top surface 40 that is located below an upper end of the non-permeable lower section of the central tube 23.

Circulating motion, induced by the cyclonic air flow 8, of hairs and other larger particles that have descended onto the flange 39 tends to be slowed down by friction between the flange 39 and the hairs and other particles. Since the central tube 23 is non-permeable in a section directly above the top surface 40 of the flange 39, an inward radial air flow that could relatively easily entrain particles, when the centrifugal forces to which these particles are subjected are reduced due to the slowing down of these particles, is at least substantially reduced. Accordingly, this adverse effect on particle separation is minimized.

Moreover, because of the absence or at least reduction of an inward radial air flow closely above the flange 39, even a relatively low rotary velocity of the particles about the central tube 23 is sufficient to cause the centrifugal forces to which the particles are subjected to prevail, so that also hairs and similarly large particles tend to migrate outward and subsequently migrate downwards past the peripheral edge of the flange 39 into the accumulating chamber 25. Thus, hairs and other large particles that have descended onto the flange 39 are more reliably separated to the outside of the separating chamber 20 where they accumulate together with other dirt and dust.

To increase the likelihood that particles on top of the flange 39 are not again entrained to the holes 26 in the central tube 23, the top surface 40 is preferably at least 1 cm, and more preferably at least 1.5 to 2 cm, below the upper end of the non-permeable lower section of the central tube 23.

To reduce the amount of hair and large particles that reach the filter element 28 to a minimum, the air-permeable upper section of the central tube 23 is provided with a pattern of holes 26 having a width of 1-3 mm.

Furthermore, the non-permeable lower section has an outer cross-section, and the air-permeable upper section has an outer cross-section equal to or smaller than the outer cross-section of the non-permeable lower section. Therefore, the non-permeable lower section does not project radially relative to the air-permeable upper section, so that downward migration of particles is not disturbed. Furthermore, to avoid disturbance of rotary motion of particles, the outside surface of the central tube 23 is smooth and has a circular shape. The fact that the gap between the flange 39 and the peripheral wall of the bin 21 is of constant width and extends circularly also contributes to reducing disturbance of the rotary motion of particles.

The invention claimed is:

1. A separation assembly for separating at least solid particles from air in a vacuum cleaner, comprising:

an air inlet;

an air outlet;

wall sections bounding an air flow path from the inlet to the outlet; and at least two separators for separating at least solid particles from the air, wherein the air flow path extends through said separators, an upstream one of said separators being located upstream of a downstream one of said separators, and wherein the downstream separator includes an air-permeable filter element bounding an inner space;

wherein the wall sections bounding the air flow path in the area of the downstream separator include at least a transparent section through which the filter element is visible;

wherein said inner space is located upstream of an area outside the filter element for filtering air flowing from inside the filter element to outside the filter element;

wherein the upstream separator is a cyclonic separator having a separating chamber extending about a central tube extending in an upward direction, the central tube bounding a central chamber inside the central tube, the separating chamber communicating with the central chamber via an air-permeable upper section of the central tube forming an outlet of the separating chamber, and the central tube having a non-permeable lower section; and wherein, in the operating condition, the inner space in the filter element is open in a downward direction and located above and in open communication with the non-permeable lower section of the central tube.

2. The separation assembly as claimed in claim 1, wherein the filter element includes an air-permeable membrane and a backing on the outside of the membrane, the backing being provided with at least a color or marking.

3. The separation assembly as claimed in claim 1, comprising a flange between the separating chamber and the accumulating chamber, the flange extending around the central tube to within a short distance from the peripheral wall and having a top surface below an upper end of the non-permeable lower section of the central tube.

4. A separation assembly for separating at least solid particles from air in a vacuum cleaner, the separation assembly comprising:

an air inlet;

an air outlet;

wall sections bounding an air flow path from the inlet to the outlet; and at least two separators for separating at least solid particles from the air, wherein the air flow path extends through said separators, an upstream one of said separators being located upstream of a downstream one of said separators, and wherein the downstream separator includes an air-permeable filter element bounding an inner space, wherein the wall sections bounding the air flow path in the area of the downstream separator include at least a transparent section through which the filter element is visible;

wherein said inner space is located upstream of an area outside the filter element for filtering air flowing from inside the filter element to outside the filter element; and wherein the upstream separator is a cyclonic separator comprising:

a separating chamber extending about a central tube extending in an upward direction and being bounded by a peripheral wall, the central tube bounding a central chamber inside the central tube, the separating chamber communicating with the central chamber via an air-permeable upper section of the central tube forming an outlet of the separating chamber and the central tube having a non-permeable lower section;

an accumulating chamber under the separating chamber; and a flange between the separating chamber and the accumulating chamber, the flange extending around the central tube to within a short distance from the peripheral wall and having a top surface below an upper end of the non-permeable lower section of the central tube.

5. The separation assembly as claimed in claim 4, wherein the top surface is at least 1 cm below the upper end of the non-permeable lower section.

6. The separation assembly as claimed in claim 4, wherein the air-permeable upper section of the central tube is provided with a pattern of holes having a width of 1-3 mm.

7. The separation assembly as claimed in claim 4, wherein the non-permeable lower section has an outer cross-section, and the air-permeable upper section has an outer cross-section equal to or smaller than the outer cross-section of the non-permeable lower section.

8. The separation assembly as claimed in claim 4, wherein the gap between the flange and the peripheral wall of the separating chamber is of constant width and extends circularly.

9. The separation assembly as claimed in claim 1, wherein the air-permeable membrane of the filter element meets EN 1822 standard class H10 or higher.

10. A vacuum cleaner incorporating a separation assembly according to any one of the preceding claims and including a fan in the air flow path.

11. A separation assembly for separating at least solid particles from air in a vacuum cleaner, comprising:

an air inlet;

an air outlet;

wall sections bounding an air flow path from the inlet to the outlet; and at least two separators for separating at least solid particles from the air, wherein the air flow path extends through said separators, an upstream one of said separators being located upstream of a downstream one of said separators, and wherein the downstream separator includes an air-permeable filter element bounding an inner space;

wherein said inner space is located upstream of an area outside the filter element for filtering air flowing from inside the filter element to outside the filter element; and wherein the air flow path extends from an outside portion of the upstream separator to an inside portion of the upstream separator prior to passing to the downstream separator.

* * * * *